US006698264B1

(12) United States Patent
Liao

(10) Patent No.: US 6,698,264 B1
(45) Date of Patent: Mar. 2, 2004

(54) CORE ASSEMBLY FOR A LOCK

(76) Inventor: Wan-Chien Liao, No. 35-1, Putsai Rd., Nankang Village, Puyen Hsiang, Changhua Hsien (TW)

( * ) Notice: Subject to any disclaimer, the term of this patent is extended or adjusted under 35 U.S.C. 154(b) by 0 days.

(21) Appl. No.: 10/429,728

(22) Filed: May 6, 2003

(51) Int. Cl.[7] ..... E05B 27/04

(52) U.S. Cl. ..... 70/493; 70/375; 70/409; 70/419

(58) Field of Search ..... 70/358, 419, 493, 70/375, 386, 409

(56) References Cited

U.S. PATENT DOCUMENTS

| | | | | | |
|---|---|---|---|---|---|
| 856,556 | A | * | 6/1907 | Townsend et al. | |
| 2,111,098 | A | * | 3/1938 | Segal | |
| 2,202,329 | A | * | 5/1940 | Braune | |
| 2,552,012 | A | * | 5/1951 | O'Kane | |
| 2,682,764 | A | * | 7/1954 | Kotab | |
| 3,605,462 | A | * | 9/1971 | Hermann | |
| 4,094,175 | A | * | 6/1978 | Pechner | 70/383 X |
| 4,631,942 | A | * | 12/1986 | Sierra | 70/368 |
| 4,655,063 | A | * | 4/1987 | Foshee et al. | 70/419 |
| 4,838,061 | A | * | 6/1989 | Tai-Seng | 70/493 |
| 5,060,494 | A | * | 10/1991 | Moorhouse | 70/419 |
| 5,138,856 | A | * | 8/1992 | Chyun | 70/493 |

FOREIGN PATENT DOCUMENTS

| | | | | |
|---|---|---|---|---|
| CH | 196529 | * | 6/1938 | 70/493 |
| CH | 252097 | * | 9/1948 | 70/493 |
| DE | 1107120 | * | 5/1961 | 70/358 |
| DE | 1111057 | * | 7/1961 | 70/493 |
| DE | 1190833 | * | 4/1965 | 70/493 |
| GB | 2154652 | * | 9/1985 | 70/358 |
| IT | 420310 | * | 3/1948 | 70/493 |

* cited by examiner

*Primary Examiner*—Lloyd A. Gall
(74) *Attorney, Agent, or Firm*—Rabin & Berdo, P.C.

(57) ABSTRACT

A core assembly for a lock includes a core, a sleeve, and a housing. The core has a keyhole longitudinally defined therein. An elongated slot is defined beside and communicated with the keyhole. Multiple lower lock balls are received in the core and not aligned with the elongated slot. The sleeve is securely provided outside the core. The housing is provided outside the sleeve, and has multiple upper lock balls corresponding to the lower lock balls. The lower lock balls are not accessible directly through the keyhole and the elongated slot, so that it is impossible to unlock the lock by a tool without a correct key, and the lock has a high security.

6 Claims, 6 Drawing Sheets

CORE ASSEMBLY FOR A LOCK

BACKGROUND OF THE INVENTION

1. Field of the Invention

The present invention is related to a core assembly for a lock, and more particularly to a lock core assembly of which lock balls are not directly accessible through the keyhole without a key.

2. Description of Related Art

A conventional lock generally has a core rotatably received in a housing. Multiple lower lock balls are longitudinally installed in the core, and multiple upper lock balls are longitudinally installed in the housing and respectively aligned with the upper lock balls. A keyhole is defined at a front end of the core for access by a key. When a correct key is inserted in the keyhole, the lower and upper lock balls are pushed upwards, so that the core can be rotated about the housing for unlocking the lock.

However, the lower lock balls are directly accessible through the keyhole, so a thief can conveniently push the lower lock balls by a tool inserted in the keyhole to unlock the lock.

Therefore, the invention provides a core assembly for a lock to mitigate and/or obviate the aforementioned problems.

SUMMARY OF THE INVENTION

The main objective of the invention is to provide a core assembly for a lock in which lock balls are not directly accessible by a keyhole.

Other objects, advantages and novel features of the invention will become more apparent from the following detailed description when taken in conjunction with the accompanying drawings.

DETAILED DESCRIPTION OF THE PREFERRED EMBODIMENT

Figure 1:
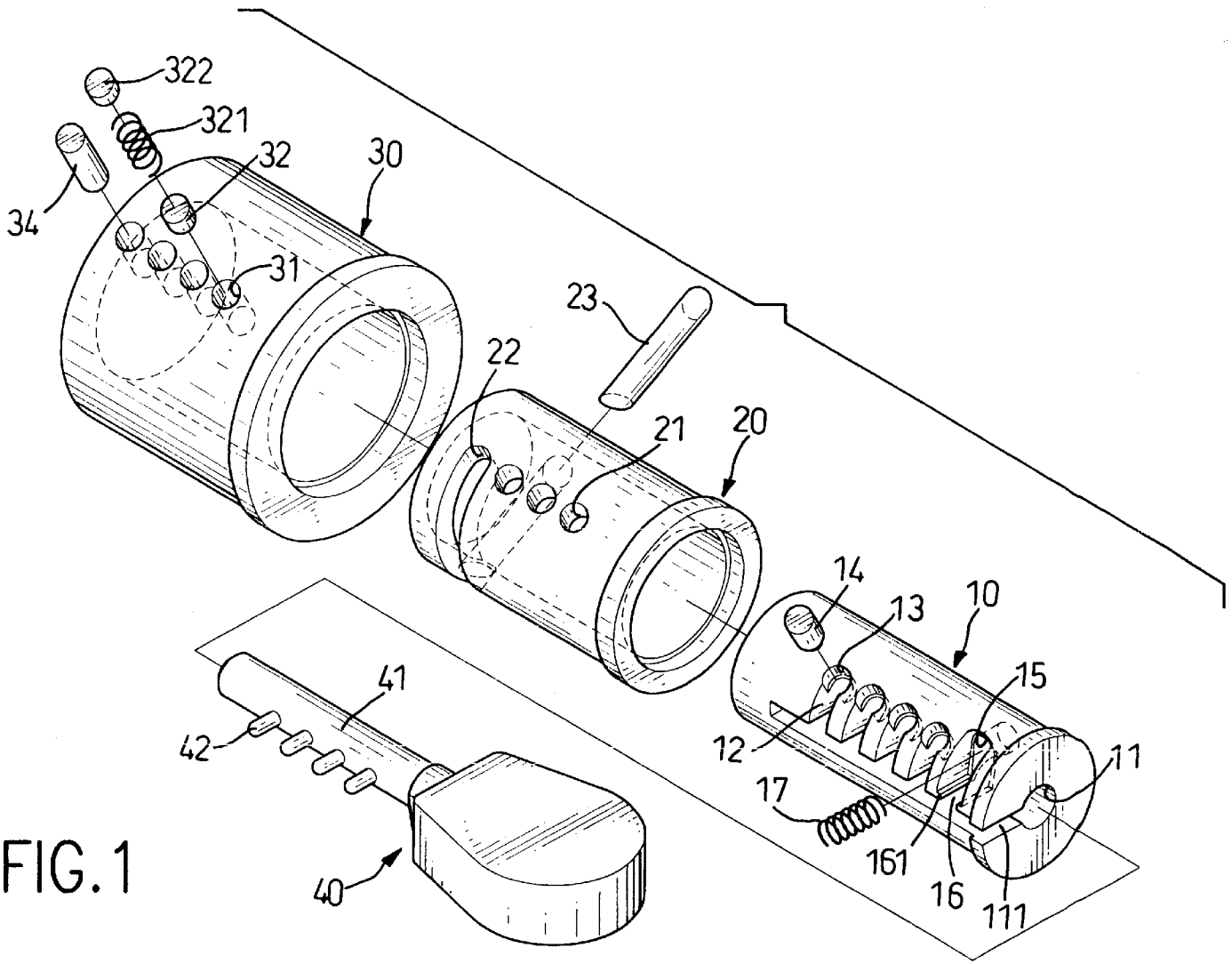
FIG. 1 is an exploded perspective view of a lock core assembly in accordance with the invention.
Figure 2:
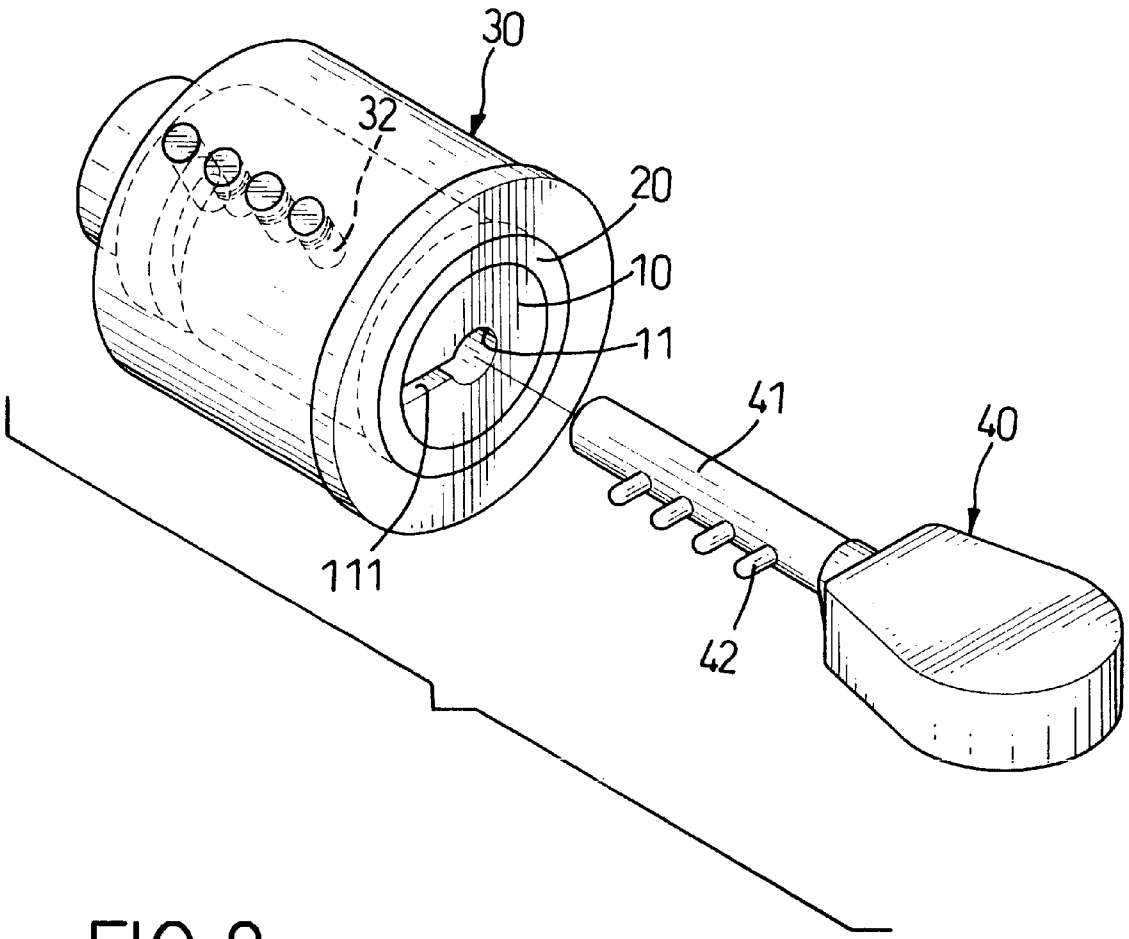
FIG. 2 is a perspective view of the lock core assembly in FIG. 1.
Figure 3:
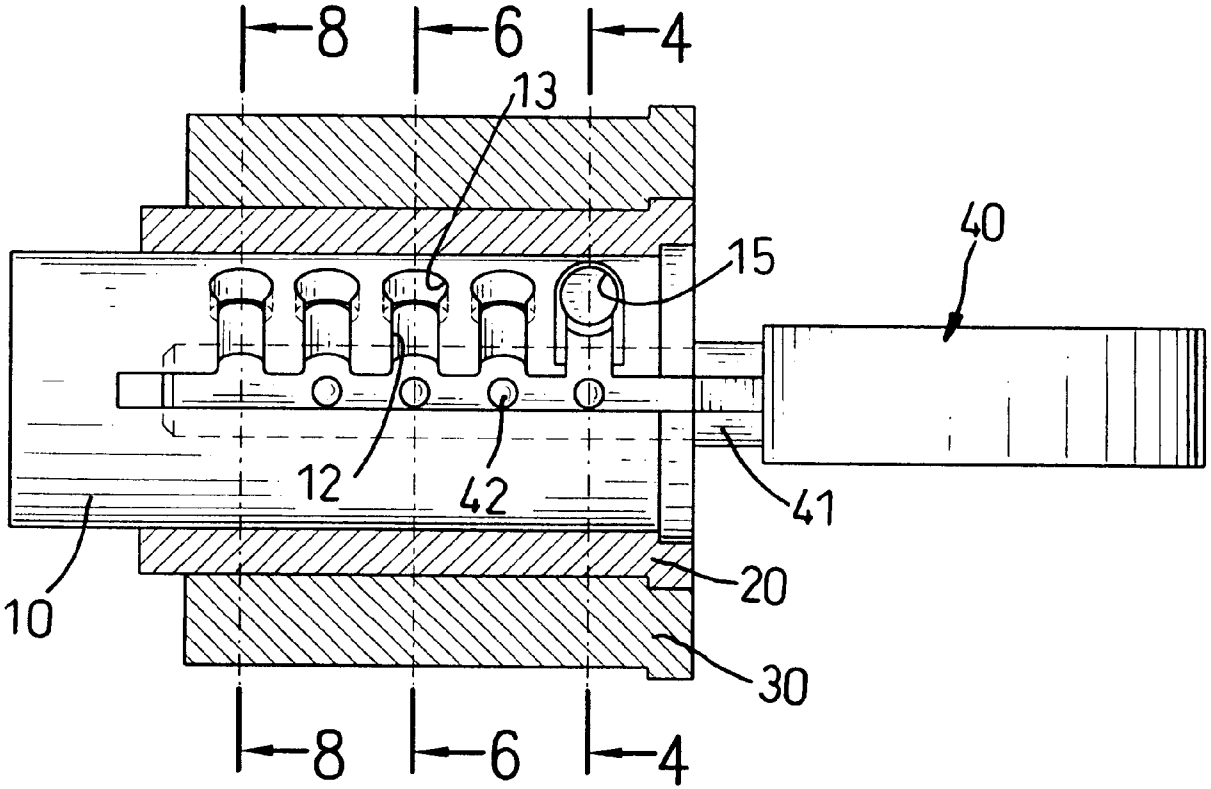
FIG. 3 is a sectional side view of the lock core assembly.

Referring to FIGS. 1–3, a lock core assembly in accordance with the invention is composed of a core (10), a sleeve (20), and a housing (30).

The core (10) has a keyhole (11) longitudinally defined therein. An elongated slot (111) is defined beside and communicated with the keyhole (11). Multiple first arcuate channels (12) are radially defined at an outer periphery of the core (10) and communicated with the elongated slot (111). Multiple first apertures (13) are respectively defined at distal ends of the first arcuate channels (12), and multiple lower lock tumbler balls (14) are respectively received in the first apertures (13). A second arcuate channel (15) is defined near a front end of the core (10) and communicated with the elongated slot (111) via an opening (16). The opening (16) has two barriers (161) formed at two side walls of the second arcuate channel (15), and a first resilient member (17) is received in the second arcuate channel (15) and blocked by the barriers (161).

The sleeve (20) is provided outside the core (10), and has multiple second apertures (21) radially defined through an outer periphery thereof and aligned with the first apertures (13) respectively. The lower lock balls (14) are partially received in the second apertures (21) respectively. An arcuate slot (22) is defined near a rear end of the sleeve (20). A first pin (23) is transversally inserted in the sleeve (20) and the core (10) to fasten the core (10) in the sleeve (20).

Figure 9:
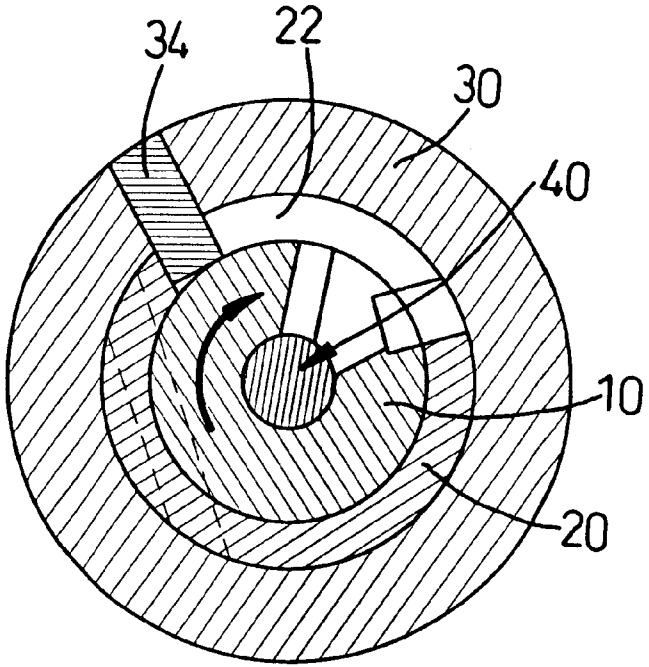
FIG. 9 is a cross sectional view of FIG. 3 along "8—8" in FIG. 3 when a key is turned.
Figure 8:
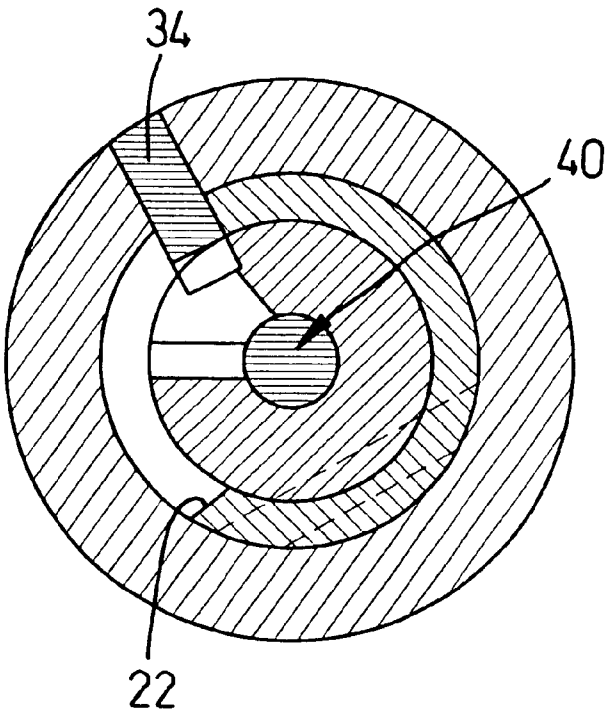
FIG. 8 is a cross sectional view of FIG. 3 along "8—8" in FIG. 3.

The housing (30) is provided outside the sleeve (20), and has multiple third apertures (31) radially defined through an outer periphery thereof and aligned with the first apertures (13) and the second apertures (21). Multiple upper lock balls (32) are respectively received in the third apertures (31), each provided with a second resilient member (321) and a plug (322) positioned thereon. Under the force of the second resilient members (321), the upper lock balls (32) abut the respective lower lock balls (14), and are partially extended in the respective second apertures (21) in a locked status. A second pin (34) is inserted in the third aperture (31) adjacent to a rear end of the housing (30) and aligned with the arcuate slot (22) of the sleeve (20), and is extended in the arcuate slot (22). Therefore, the housing (30) can be rotated about the sleeve (20) in the range of the arcuate slot (22), as shown in FIGS. 8 and 9.

Figure 5:
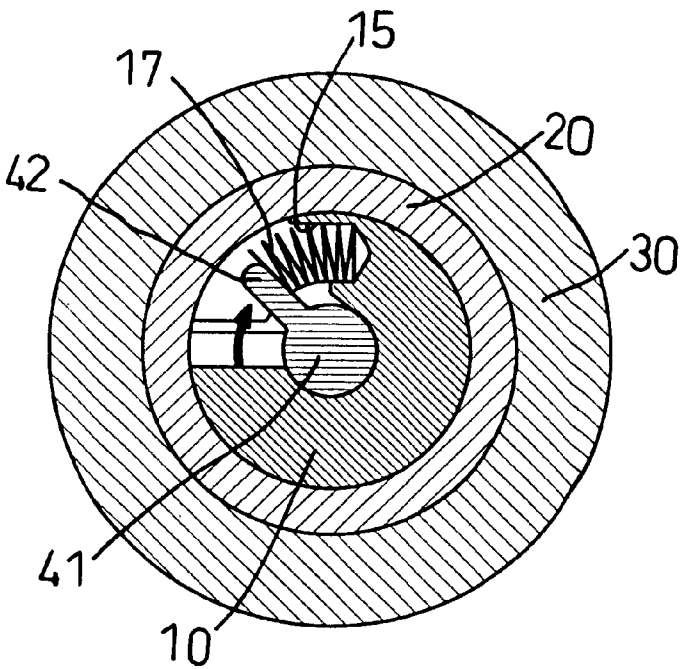
FIG. 5 is a cross sectional view of FIG. 3 along "4—4" in FIG. 3 when a key is turned.
Figure 4:
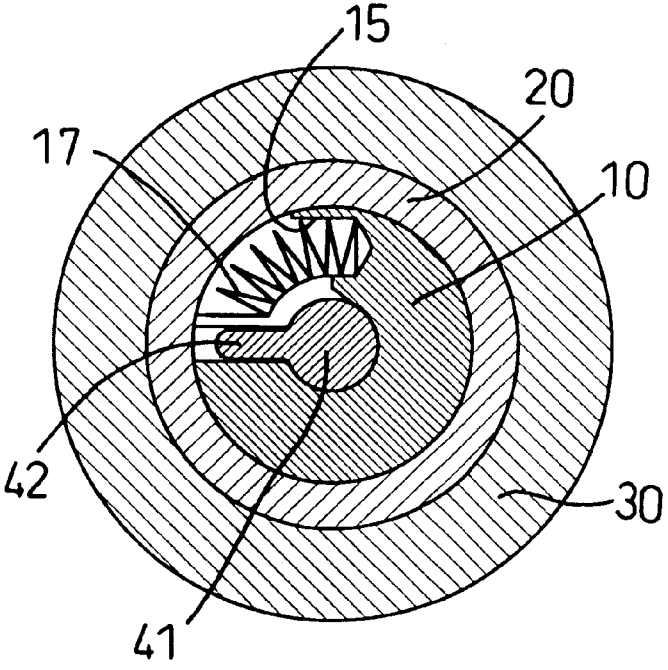
FIG. 4 is a cross sectional view of FIG. 3 along "4—4" in FIG. 3.
Figure 7:
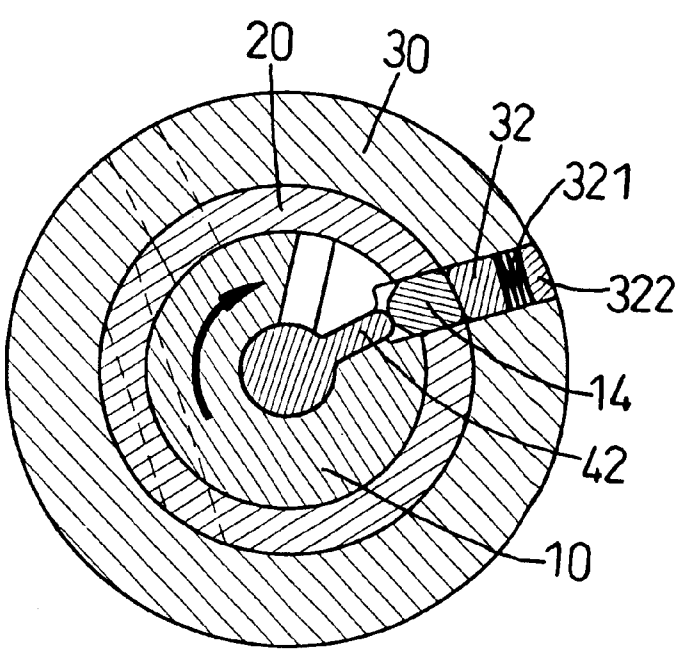
FIG. 7 is a cross sectional view of FIG. 3 along "6—6" in FIG. 3 when a key is turned.
Figure 6:
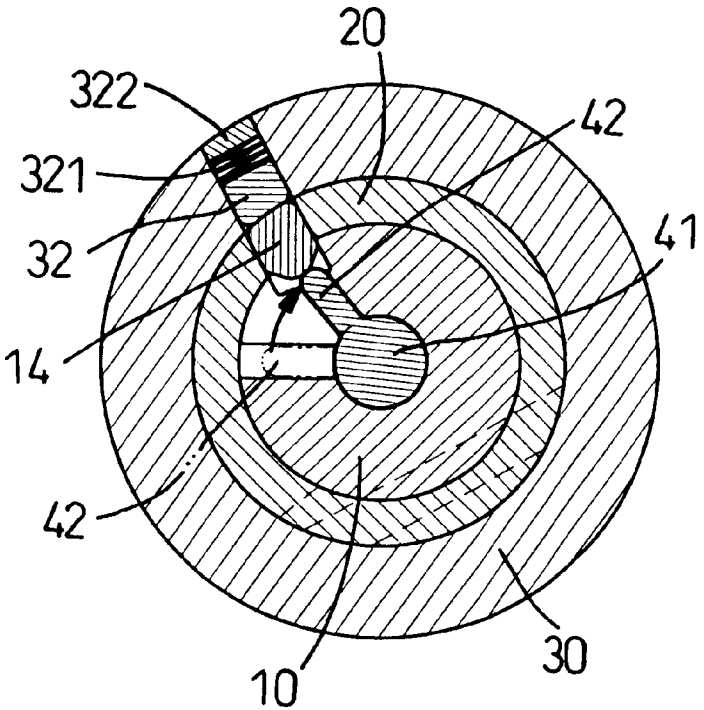
FIG. 6 is a cross sectional view of FIG. 3 along "6—6" in FIG. 3.

Referring to FIGS. 2–4, in the core assembly, the lower lock balls (14) can not be seen through the keyhole (11) and elongated slot (111). A key (40) for the core assembly has a shank (41) with multiple tongues (42). The key (40) is inserted in the keyhole (11) and the tongues (42) are received in the elongated slot (111). When the key (40) is rotated, the tongues (42) are respectively received in the first and second arcuate channels (12, 15). Referring to FIGS. 3–5, the first resilient member (17) is compressed by one of the tongues (42), and the lower lock balls (14) are pushed upwards by the other tongues (42). When the interfaces between the lower lock balls (14) and the upper lock balls (32) are located in the interface between the sleeve (20) and the housing (30), the core (10) and the sleeve (20) can be rotated about the housing (30) by turning the key (40), as shown in FIGS. 6 and 7. Referring to FIGS. 8 and 9, by the second pin (34) extending in the arcuate slot (22), the core (10) and the sleeve (20) can only be rotated in the angle corresponding to the arcuate slot (22).

For locking, under the elastic force of the first resilient member (17), the key (40) can be rapidly returned to the elongated slot (111), and the tongues (42) are disengaged from the lower lock balls (14). Therefore, the upper lock balls (32) are pushed downwards under the force of the second resilient members (321) and partially extend in the second apertures (21) of the sleeve (20), and the core (10) and the sleeve (20) can not be rotated about the housing (30).

Therefore, according to the present invention, the lower lock balls (14) can not be seen through the keyhole (11) and are not aligned with the elongated slot (111), so that it is impossible for a thief to push the lower lock balls (14) by a tool, and the lock will have a high security.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A core assembly for a lock comprising:

a core (10) having a keyhole (11) longitudinally defined therein, an elongated slot (111) defined beside and communicated with the keyhole (11), multiple first arcuate channels (12) radially defined at an outer periphery of the core (10) and communicated with the elongated slot (111), multiple first apertures (13) respectively at distal ends of the first arcuate channels (12), and multiple lower lock tumblers (14) respectively received in the first apertures (13);

a sleeve (20) securely provided outside the core (10), the sleeve (20) having multiple second apertures (21) radially defined through an outer periphery thereof and aligned with the first apertures (13) respectively, the first lower lock tumblers (14) partially received in the second apertures (21); and a housing (30) provided outside the sleeve (20), the housing (30) having multiple third apertures (31) radially defined through an outer periphery thereof and aligned with the first apertures (13) and the second apertures (21), multiple upper lock tumblers (32) respectively received in the third apertures (31), each upper lock tumbler (32) provided with a second resilient member (321) and a plug (322) positioned thereon, the upper lock tumblers (32) abutting the respective lower lock tumblers (14) and partially extending in the second apertures (21) in a locked status.

2. The core assembly as claimed in claim 1, wherein the core (10) further has a second arcuate channel (15) defined near a front end thereof and communicated with the elongated slot (111) via an opening (16), two barriers (161) formed at two side walls of the opening (16), and a first resilient member (17) received in the second arcuate channel (15) and blocked by the barriers.

3. The core assembly as claimed in claim 1, wherein the sleeve (20) and the core (10) are fastened by a first pin (23) transversally inserted through the core (10) and the sleeve (20).

4. The core assembly as claimed in claim 2, wherein the sleeve (20) and the core (10) are fastened by a first pin (23) transversally inserted through the core (10) and the sleeve (20).

5. The core assembly as claimed in claim 3, wherein the sleeve (20) further has an arcuate slot (22) defined near a rear end thereof, and the housing (30) further has a second pin (34) inserted through a third aperture (31) adjacent to a rear end of the housing (30) and aligned with the arcuate slot (22) of the sleeve (20), and extending in the arcuate slot (22).

6. The core assembly as claimed in claim 4, wherein the sleeve (20) further has an arcuate slot (22) defined near a rear end thereof, and the housing (30) further has a second pin (34) inserted through a third aperture (31) adjacent to a rear end of the housing (30) and aligned with the arcuate slot (22) of the sleeve (20), and extending in the arcuate slot (22).

* * * * *